US005270939A

United States Patent [19]

Goldberg et al.

[11] Patent Number: 5,270,939

[45] Date of Patent: Dec. 14, 1993

[54] METHOD FOR MODIFYING EMBROIDERY DESIGN PROGRAMS

[76] Inventors: Brian J. Goldberg, 108 Venice Crescent, Thornhill, Ontario, Canada, L4J 7T1; Anastasios Tsonis, 185 Golf Course Road, Village of Conestogo Township of Woolwich, Ontario, Canada, N0B 1N0

[21] Appl. No.: 798,554

[22] Filed: Nov. 26, 1991

[51] Int. Cl.[5] ..... G06F 15/46; D05B 19/00

[52] U.S. Cl. ..... 364/470; 112/457; 112/458

[58] Field of Search ..... 364/470; 112/112.12, 112/157, 458, 456, 457

[56] References Cited

U.S. PATENT DOCUMENTS

| | | | |
|---|---|---|---|
| 4,227,472 | 10/1980 | Bergvall | 112/456 |
| 4,326,473 | 4/1982 | Kigawa | 112/456 |
| 4,352,334 | 10/1982 | Childs et al. | 112/266.1 |
| 4,720,795 | 1/1988 | Kinoshita et al. | 364/470 |
| 4,807,143 | 2/1989 | Matsuura | 364/470 |
| 4,821,662 | 4/1989 | Pongrass et al. | 112/266.1 |
| 4,849,902 | 7/1989 | Yokoe et al. | 364/470 |
| 4,919,062 | 4/1990 | Yokoe et al. | 112/121.12 |
| 5,056,444 | 10/1991 | Lowry et al. | 112/221 |

FOREIGN PATENT DOCUMENTS

| | | |
|---|---|---|
| 4107177A1 | 12/1990 | Fed. Rep. of Germany . |
| 4101123A1 | 7/1991 | Fed. Rep. of Germany . |
| 4104320A1 | 8/1991 | Fed. Rep. of Germany . |
| 4105089A1 | 8/1991 | Fed. Rep. of Germany . |
| 4139203A1 | 7/1992 | Fed. Rep. of Germany . |

*Primary Examiner*—Jerry Smith
*Assistant Examiner*—Paul Gordon
*Attorney, Agent, or Firm*—Bryan Cave

[57] ABSTRACT

This invention relates to a method for converting low-level stitch-by-stitch numerical control code embroidery design programs into an outline format which can be edited and modified to generate new design patterns which may be converted back to either stitch-by-stitch numerical control codes or a condensed data format. The invention permits a user to independently vary and modify a large variety of characteristics of an existing embroidery design control program including converting straight line portions of a design pattern to smoothed curves, converting a portion or all of the stitching in a design from one type of stitching, such as satin, bean or tatami, to a different type of stitching, changing stitch lengths in any fill patterns or stitch runs, changing the fill patterns in any fill stitches, adding or deleting automatic underlay stitching, changing the density of stitching in any portion of a design, moving or deleting any portion or point, copying, rotating, scaling, and mirroring any portion of a design, correcting satin segment points which are reversed, changing fill angles, changing the order of sewing segments, and changing the color of any portion of a design.

16 Claims, 6 Drawing Sheets

| RUN NO. | FIRST STITCH | LAST STITCH | ANGLE TYPE |
|---|---|---|---|
| 1 | 1 | 5 | V BIG |
| 2 | 6 | 21 | V SMALL |
| 3 | 21 | 22 | BIG |
| 4 | 25 | 26 | V BIG |
| 5 | 27 | 27 | V SMALL |
| 6 | 28 | 29 | V BIG |
| 7 | 30 | 30 | V SMALL |
| 8 | 31 | 32 | V BIG |
| 9 | 33 | 33 | V SMALL |
| 10 | 34 | 35 | V BIG |
| 11 | 36 | 36 | V SMALL |
| 12 | 37 | 38 | V BIG |
| 13 | 39 | 39 | V SMALL |
| 14 | 40 | 42 | V BIG |

FIG. 3

| RUN NO. | ANGLE TYPE | STITCH TYPE |
|---|---|---|
| 1 | V BIG | RUN |
| 2 | V SMALL | SATIN |
| 3 | BIG | RUN |
| 4 | UNDETERMINED OR RUN | UNDETERMINED OR RUN |
| 5 | UNDETERMINED OR RUN | UNDETERMINED OR RUN |
| 6 | UNDETERMINED OR RUN | UNDETERMINED OR RUN |
| 7 | UNDETERMINED OR RUN | UNDETERMINED OR RUN |
| 8 | UNDETERMINED OR RUN | UNDETERMINED OR RUN |
| 9 | UNDETERMINED OR RUN | UNDETERMINED OR RUN |
| 10 | UNDETERMINED OR RUN | UNDETERMINED OR RUN |
| 11 | UNDETERMINED OR RUN | UNDETERMINED OR RUN |
| 12 | UNDETERMINED OR RUN | UNDETERMINED OR RUN |
| 13 | UNDETERMINED OR RUN | UNDETERMINED OR RUN |
| 14 | UNDETERMINED OR RUN | UNDETERMINED OR RUN |

FIG. 4

| RUN NO. | ANGLE TYPE | STITCH TYPE |
|---|---|---|
| 1 | V BIG | RUN |
| 2 | V SMALL | SATIN |
| 3 | BIG | RUN |
| 4 | V BIG | TATAMI |
| 5 | NS SMALL | TATAMI |
| 6 | V BIG | TATAMI |
| 7 | V SMALL | TATAMI |
| 8 | V BIG | TATAMI |
| 9 | V SMALL | TATAMI |
| 10 | V BIG | TATAMI |
| 11 | V SMALL | TATAMI |
| 12 | V BIG | TATAMI |
| 13 | V SMALL | TATAMI |
| 14 | V BIG | TATAMI |

FIG. 5

METHOD FOR MODIFYING EMBROIDERY DESIGN PROGRAMS

FIELD OF THE INVENTION

The present invention relates to a method for converting low-level stitch-by-stitch numerical control code embroidery design programs into an outline format which can be edited to generate new and modified design patterns.

BACKGROUND OF THE INVENTION

Embroidery machines are generally controlled by programs. Two primary program formats are utilized to control embroidery machines: (1) low-level stitch-by-stitch numerical control codes ("stitch data"); and (2) condensed, high-level, data. The information contained in stitch data typically comprises three main components: (i) a relative movement in the "x" (horizontal) direction in the plane of the work surface; (ii) a relative movement in the "y" (vertical) direction in the plane of the work surface; and (iii) control information, such as whether the machine should pause, stop, change thread color, penetrate a fabric, etc. Unfortunately, no uniform standard has been adopted by the embroidery industry for encoding and storing this information, rather, each manufacturer typically develops and utilizes its own unique encoding and storage system.

A separate program is required for each embroidery design. There are very few methods available which provide the ability to modify existing embroidery design programs. Methods that are available for modifying existing embroidery design programs are extremely limited. Prior methods for editing embroidery design programs have primarily been limited to increasing or decreasing the size of a pattern, varying stitch densities, changing the orientation of a design, producing a mirror image of a design, and varying fill, running, jump and satin stitch lengths.

Examples of such prior art systems for varying the parameters associated with a stitch pattern design in order to control stitching machinery, such as an embroidery machine or a sewing machine, are disclosed in Pongrass et al., U.S. Pat. No. 4,821,662 and Kinoshita et al., U.S. Pat. No. 4,720,795. These prior art methods, however, are limited in their editing capability and, for example, provide no means for converting straight line portions of a design pattern to smoothed curves, nor do they provide a means for converting a portion or all of the stitching in a design from one type of stitching, such as satin or tatami, to a different type of stitching. Furthermore, the methods currently available do not permit a user to convert an embroidery design program into an outline format which can be easily edited and manipulated.

BRIEF SUMMARY OF THE INVENTION

The present invention provides an efficient method for converting low-level stitch-by-stitch numerical control codes ("stitch data") for embroidery design programs into a condensed, high-level, data outline format ("condensed outline data") which may be edited, modified and then preferably converted back to stitch data.

The invention permits a user to independently vary and modify a large variety of characteristics of an existing embroidery design program including the ability to provide modifications not readily available using prior art methods. For example, by employing the presently preferred method of the present invention straight line portions of a design pattern may be converted to smoothed curves, a portion or all of the stitching in a design may be converted from one type of stitching, such as satin or tatami, to a different type of stitching, stitch lengths in any fill patterns or stitch runs may be changed, the fill patterns in any fill stitches may be changed, automatic underlay stitching may be added or deleted, the density of stitching in any portion of a design may be changed, any portion or point may be moved or deleted, any portion of a design may be copied, rotated, scaled, and/or mirrored, satin segment points which are reversed may be corrected, fill angles may be changed, the order of sewing segments may be changed, and/or the color of any portion of a design may be changed.

The outline format of the present invention permits a user, on a computer display screen, to instantly review and visualize the changes which are being made to an original design. Additionally, once the new design is complete, the present invention may output the new design to be stored in either stitch data or condensed data format.

BRIEF DESCRIPTION OF THE DRAWINGS

Further features of the invention, its nature and various advantages will be more apparent from the accompanying drawings and the following detailed description of the invention in which like reference numerals refer to like elements, and in which:

FIG. 3 is a table showing the stitch angles and runs in the sample embroidery design pattern of FIG. 1 categorized in the first "loop through" of the presently preferred method of the present invention.

FIG. 4 is a table showing the stitch types of the runs in the sample embroidery design pattern of FIG. 1 categorized in the second "loop through" of the presently preferred method of the present invention.

FIG. 5 is a table showing the stitch categorization of runs of the sample embroidery design pattern of FIG. 1 in the third "loop through" of the presently preferred method of the present invention which were unidentified in the second loop;

DETAILED DESCRIPTION OF THE INVENTION

Figure 8:
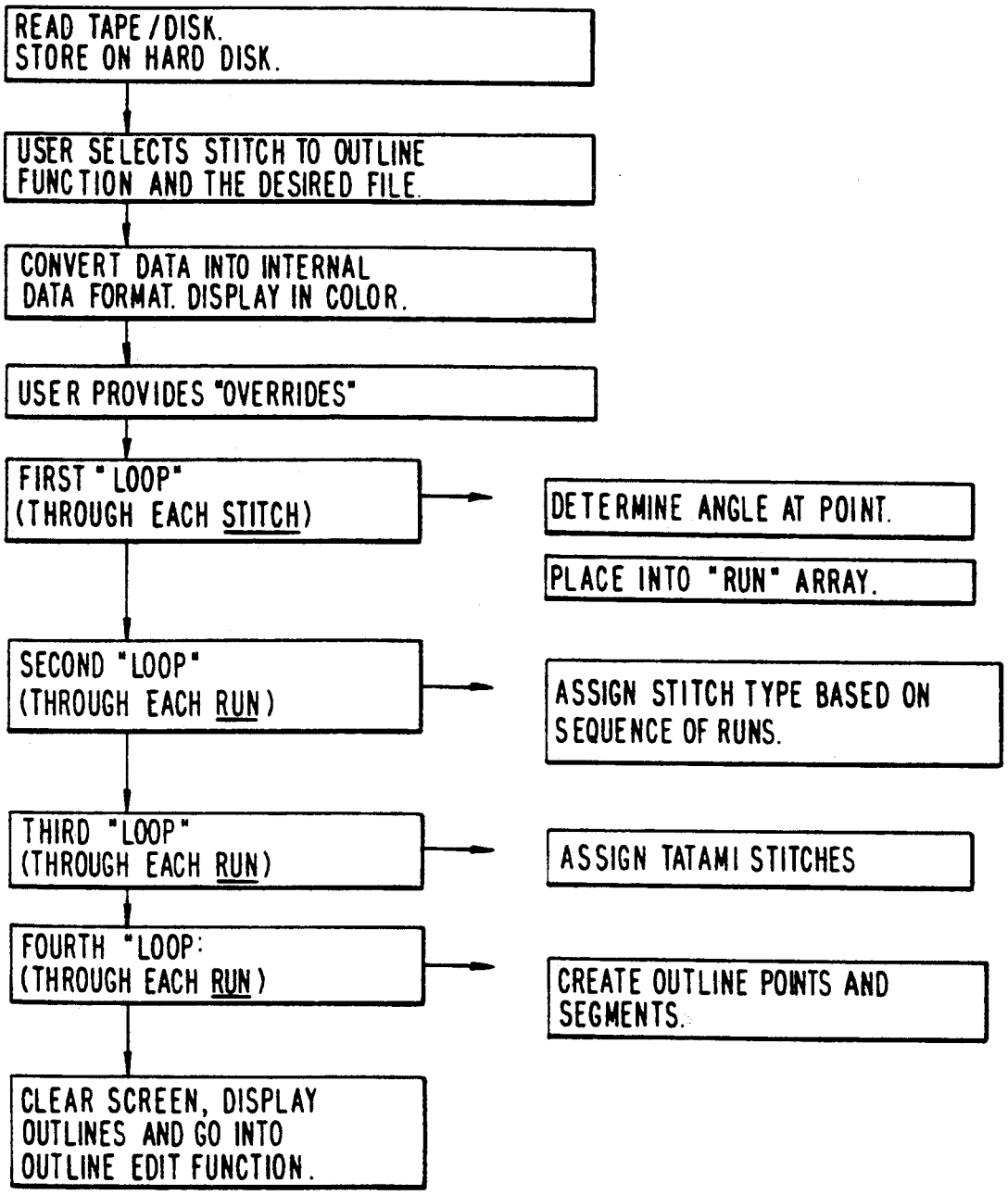
FIG. 8 is a macro flow chart illustrating the presently preferred method of the present invention.

Referring to the drawings in detail, and initially to FIG. 8, the presently preferred method of the present invention is illustrated. FIG. 8 is a macro flow chart of the various steps of the presently preferred method of the present invention. The method of the present invention provides an efficient method for converting low-level stitch-by-stitch numerical control codes ("stitch data") for embroidery design programs into a condensed, high-level, data outline format ("condensed outline data") which may be edited, modified and then preferably converted back to stitch data.

In accordance with the presently preferred method of the present invention, the stitch data of an embroidery design pattern is initially transferred or copied into a conventional computer, such as an IBM PC compatible, from whatever type of media that the stitch data has been stored on. Of course, if desired, the use of various conventional system hardware and software configurations may permit the stitch data to be directly used by the present invention without the necessity of initially transferring or copying the stitch data into the computer. Traditionally, in the embroidery industry, stitch data is stored on paper tape, computer diskettes or cassettes. The stitch data generally contains three (3) basic components: (i) a relative coordinate movement in the "x" direction (horizontal) in the plane of the work surface; (ii) a relative coordinate movement in the "y" direction (vertical) in the plane of the work surface; and (iii) control information. Control information typically includes information such as whether the embroidery machine should pause or stop for the placement of an applique, change thread color, penetrate a fabric, etc.

After the stitch data is conventionally loaded into the computer, such as an IBM PC compatible, the presently preferred method of the present invention may be employed to begin the conversion process. In accordance with the presently preferred method of the present invention, once the method of the present invention is initiated, a user driven menu will appear on the computer display screen. Because there may be more than one file of stitch data in the computer or system, the user driven menu preferably conventionally prompts the user to select the stitch data desired for conversion to condensed outline data format for editing. After the user selects a stitch data file, the stitch data is then preferably converted into a unique numerical coding scheme and read into the computer's RAM. The coding scheme preferably assigns an absolute location in a cartesian coordinate space to each stitch with the first stitch being placed at the origin, and the control data is put into an absolute form.

The converted stitch data is then preferably conventionally scaled to fit onto whatever size computer screen the system is configured for and from curvilinear to linear and conventionally displayed on the computer screen. In accordance with the presently preferred method of the present invention, the converted stitch data may be displayed in color or in shades of grey and each stitch is preferably represented by a line. When color control codes are identified, the stitch lines will change color or grey shades to represent the actual characteristics of the embroidery design pattern.

After the converted stitch data is conventionally displayed on the computer display screen, the user is then preferably prompted to provide the following information and design characteristics:

1) The name or title of the new Outline file which is being created;

2) Whether the user would like to change the Satin density and/or the Tatami density ("override"):

a) If the user chooses to override either the Satin or Tatami densities, the user is then preferably prompted to input the density desired for the stitch densities to be overridden. Thereafter, every time the system recognizes a corresponding stitch type, Satin or Tatami, in accordance with the presently preferred method it will incorporate the respective stitch density input by the user to that segment;

b) If the user chooses to keep an existing stitch density, in accordance with the presently preferred method, the system of the present invention will analyze and calculate the respective type of stitch density and assign an estimated density to that segment;

3) In order to ensure the uniformity of the design, in accordance with the presently preferred method, the user may specify a specific pattern to be used whenever the system of the present invention identifies a Tatami stitch. Otherwise, the system of the present invention will preferably estimate a pattern every time a Tatami stitch is identified;

4) Whether the user would like to change the fill pattern ("override") and introduce a new fill pattern;

5) The length of the Run stitches in the design. The length of the Run stitches are preferably always overridden. If the user fails to input a desired Run stitch, a default value is used. The step ensures uniformity of the design by avoiding inconsistencies which could result from estimating the length of each run.

After the user responds to the prompted queries, in accordance with the presently preferred method, the system preferably "loops through" the stitch data and identifies and analyzes each stitch point. At this point, the method of the present invention preferably includes the following steps:

1) The stitch data is preferably scanned for control information. If the first stitch identified is a jump, it is skipped over and the next stitch is analyzed.

2) The stitch is preferably scanned to determine whether the stitch is at the same location as the previous or succeeding stitch (these are known as "zero movement" stitches). If so, the zero movement stitch is ignored.

3) The angle formed at the stitch point by the vector of the immediately preceding stitch and the vector of the stitch being analyzed is then preferably determined. By way of example, FIG. 2 shows the angles present in the sample embroidery design pattern of FIG. 1 which have been determined in this step of the presently preferred method of the present invention.

4) The angle determined in the preceding step is then preferably coded and classified as being within one of the following categories according to the size of the angle:

a) if the absolute value of the angle is less than a predefined constant ("VSMALL"), the angle is classified as VSMALL;

b) if the absolute value of the angle is larger than the constant "VSMALL" but less than a predefined constant ("SMALL"), the angle is classified as "SMALL";

c) if the classification of the previous angle is "SMALL", the present angle and the previous angle have opposite signs, and the absolute value of the sum of both the previous angle and the present angle is less than the constant "VSMALL", then the present angle is classified as "SMALL";

d) if the angle is not classified as "VSMALL" or "SMALL" and the absolute value of the angle is less than a predefined constant "VBIG", then the present angle is classified as "BIG";

e) if the angle is not classified as "VSMALL", "SMALL", or "BIG", then it is classified as "VBIG."

5) Stitches with similar characteristics are grouped into an array of runs or sequences. A new run is preferably initiated whenever any of the following characteristics are present:

a) the angle of a previous stitch could not be calculated for any reason;
b) the movement from the previous stitch to the present stitch or from the present stitch to the next stitch exceeds a predefined number of consecutive jump stitches;
c) the angle classification of the present stitch is different from the previous stitch and either the previous angle or the present angle were classified as either "BIG" or "VBIG";
d) the angle of the present stitch is classified as "SMALL" and has the same sign as the angle of the previous stitch; or
e) the present stitch is not the same color as the previous stitch.

Figure 1:
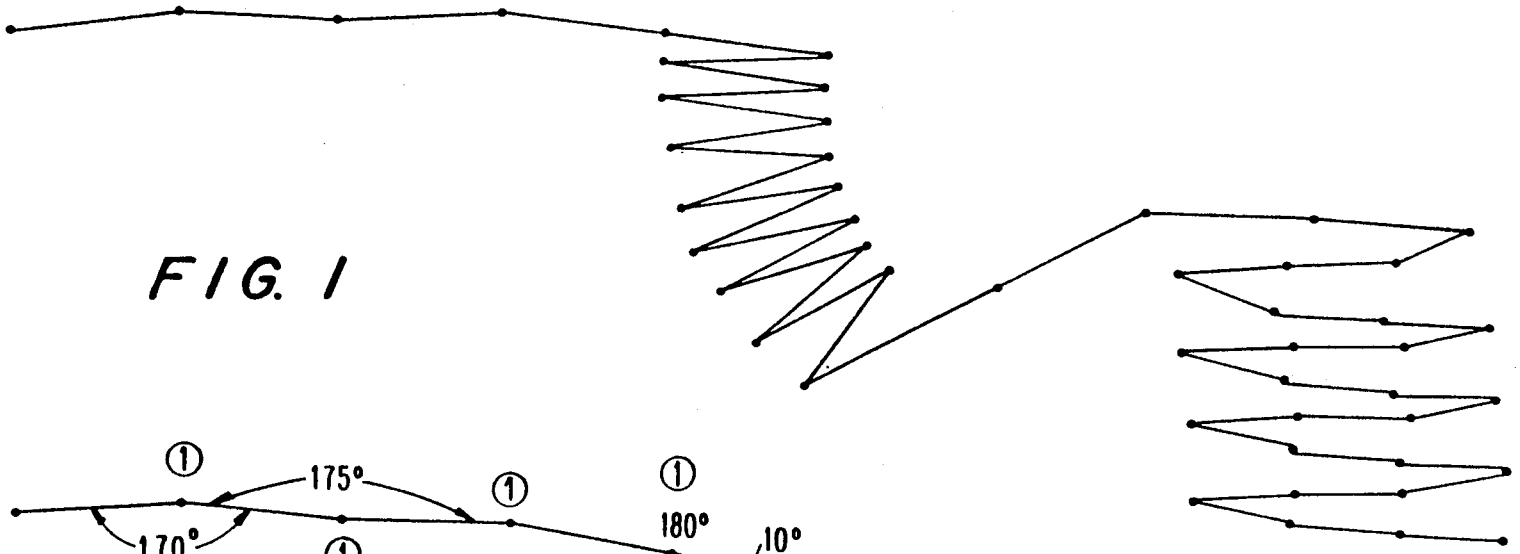
FIG. 1 is an illustration of sample embroidery design pattern.
Figure 2:
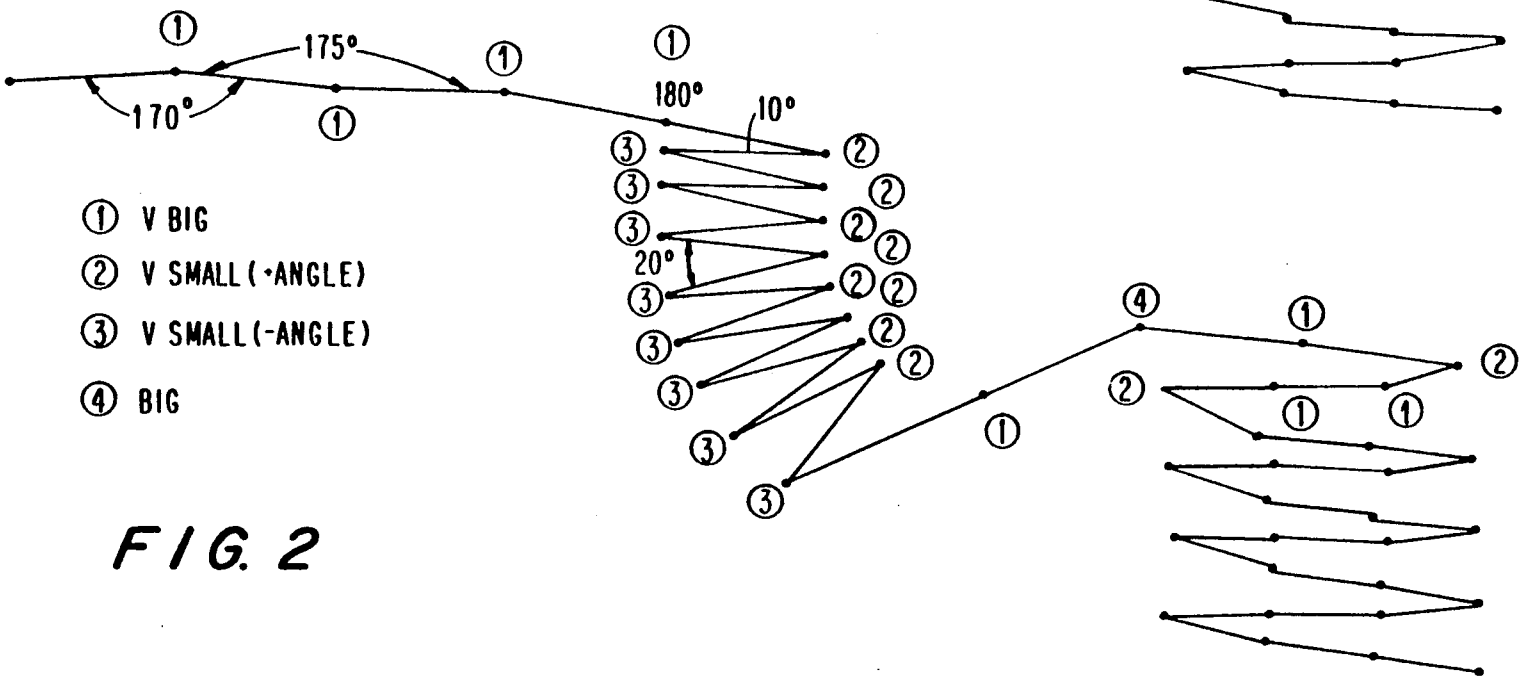
FIG. 2 is a diagrammatic illustration showing the angles formed at stitch points on the sample embroidery design pattern of FIG. 1.

Referring now to FIG. 3, FIG. 3 is a table which shows the runs, associated stitches and angle classifications of the sample embroidery design pattern of FIG. 1 which have been determined during the first "loop through" of the presently preferred method of the present invention.

6) In accordance with the presently preferred method of the present invention, the system then preferably "loops through" each of the runs a second time and assigns a stitch type to each run (for example "Satin", "Tatami" or "Bean"). The stitch type assigned to a run is preferably determined by utilizing the following control patterns:

a) The present run and the succeeding run are classified as "Bean" stitches if:
   i) the angle of the present run has been classified as "VSMALL", the number of stitches in the run is two (2), and the next run has only one stitch and the angle of the next run is not "VSMALL"; or
   ii) the angle of the present run has not been classified as "VSMALL", there is only one (1) stitch in the run, the angle of the succeeding run is "VSMALL", and there are two (2) stitches in the succeeding run.
b) If the run is not classified as a "Bean" stitch, the run is classified as a "Run" stitch if:
   i) the angle of the run could not be calculated; or
   ii) the angle of the run has been classified as "BIG" and there is more than one (1) stitch in the run; or
   iii) there is only one (1) stitch in the run and it has been classified as either "BIG" or "VBIG"; or
   iv) there are two (2) or three (3) stitches in the run and the run has been classified as either "VSMALL" or "SMALL".
c) If the run is not classified as a "Bean" or a "Run" stitch, the run is classified as a "Satin" stitch if the angle has been classified as either "SMALL" or "VSMALL" and there are more than a predefined number of stitches in the run.
d) If the run does not fall within any of the previous classifications, then it is classified in the next step.

Referring now to FIG. 4, FIG. 4 is a table showing the stitch types of the runs in the sample embroidery design of FIG. 1 determined in the second "loop through" of the presently preferred method of the present invention.

7) The runs are preferably "looped through" a third time to identify any "Tatami" stitches. This is done because "Tatami" stitches look like a series of straight "Run" stitches separated by single stitches with a small angle. Additionally, the process is quicker at this point because the "Run" stitches have already been classified. The following classifications preferably occur in this step:

a) If in a series of three runs the first and second runs are classified as "Bean" stitches and the third run is not, then the third run is re-classified as a "Run";
b) If a run is a "Run" stitch or has not been classified and the run is in a series of a predefined number of runs in which the angle classifications of the runs alternate between "VBIG" and either "SMALL" or "VSMALL", all nine (9) runs are classified or re-classified as "Tatami".

Referring now to FIG. 5, FIG. 5 is a table showing the stitch type categorization of the sample embroidery design pattern shown in FIG. 1 determined during the third "loop through" of the presently preferred method of the present invention.

8) The method of the present invention then preferably "loops through" the runs one final time (a fourth time) in order to generate outline segments and points from the stitch points and runs. Outline points are preferably scaled to fit into a predefined coordinate space. The scale of the design is preferably selected to ensure that there are no negative locations thereby reducing the amount of internal memory required.

This final stage of the method of the present invention preferably includes the following steps:

a) If a run has been classified as a "Run" stitch, an outline segment is preferably created for the run and all consecutive subsequent runs that have also been classified as "Run" stitches. Outline points in this segment are preferably placed wherever a stitch point is identified. The stitch length is preferably set according to the user's previous input or the default value.
b) If a run has been classified as a "Bean" stitch, an outline segment is preferably created for the run and all consecutive subsequent runs that are also "Bean" stitches. The Outline points in this segment are preferably placed at every fourth stitch. The placement of the stitches in this manner skips over the Bean-type pattern and provides a line in which Bean stitches may later be placed.
c) If a run has been identified as a "Satin" stitch, an outline segment is preferably created for the run. The outline points are preferably placed at stitch points, but not necessarily at all of the stitch points. The number of outline points placed at stitch points is dependent upon the number of points in the run.

The density of the Satin stitches is preferably set according to the density selected and input by the user or it is calculated from the existing stitches. If the density is calculated, the density is determined by averaging the distance between stitches at several points in the segment. d) If a run has been classified as a "Tatami", an outline segment is preferably created for the run and all consecutive subsequent runs that are also Tatami stitches. Outline points are preferably placed where the angles of a run have been classified as either "SMALL" or "VSMALL". Positioning the outline points in this manner provides for outlines occurring only at the end points of each Tatami stitch line.

The density of the Tatami stitches is preferably set according to the density specified by the user or it is calculated from the existing stitches. If the density is calculated, the density is preferably determined by averaging the distance between stitches at several points in the segment.

The pattern of the Tatami stitches is preferably set according to the pattern specified by the user or it is calculated. If the pattern is calculated, the pattern is preferably determined by identifying how the stitches in the first few runs align relative to a predefined grid.

Figure 6:
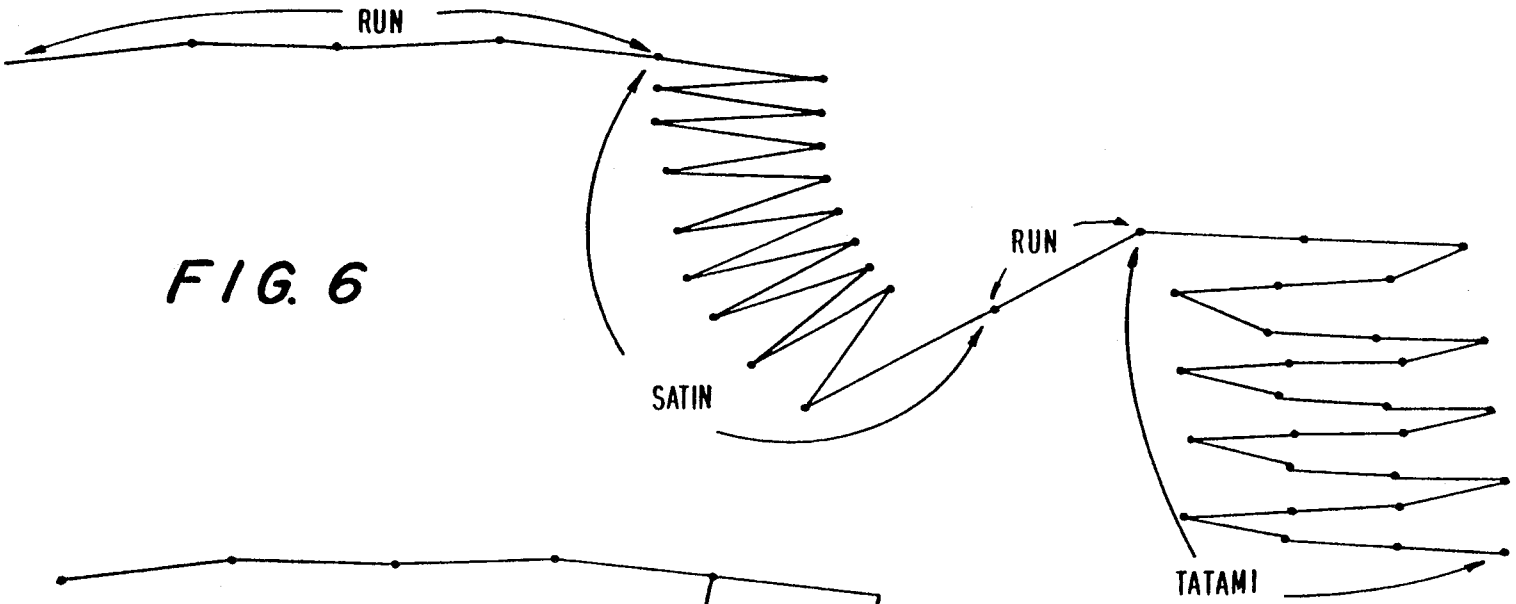
FIG. 6 is an example of outline points and segments of the sample embroidery design pattern of FIG. 1 generated in the fourth "loop through" of the presently preferred method of the present invention.
Figure 7:
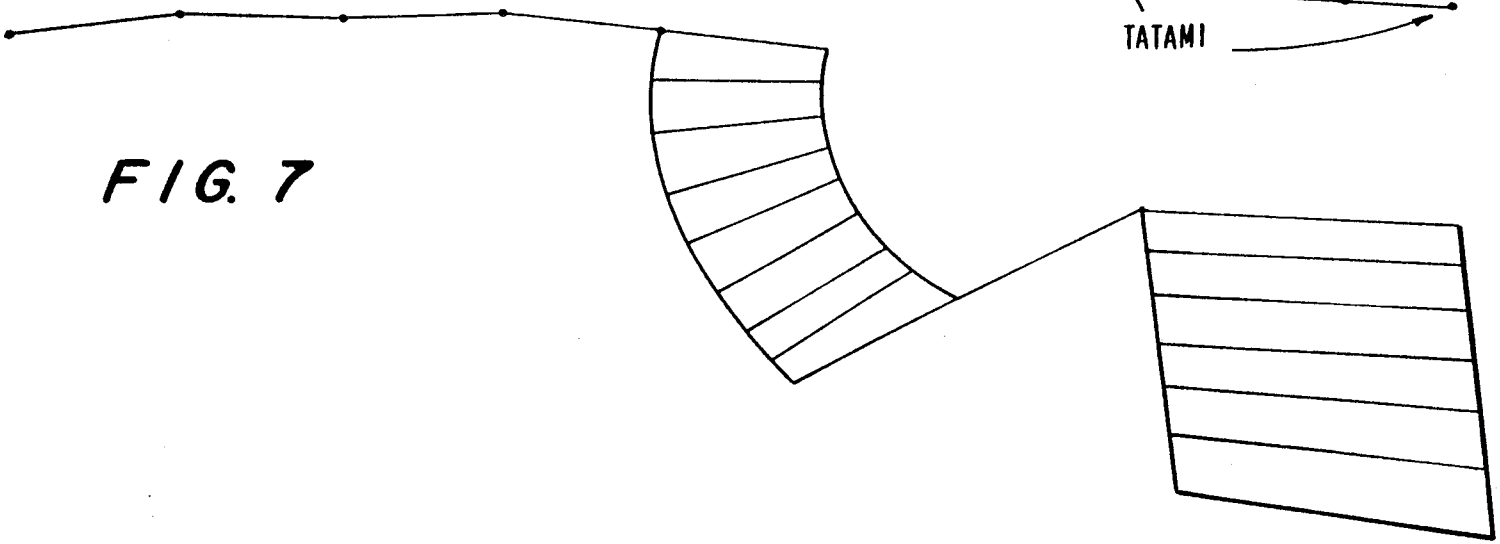
FIG. 7 is an illustrative example of an outline of the sample embroidery design program based on the pattern of FIG. 1 which has been created by the presently preferred method of the present invention.

Referring now to FIGS. 6 and 7, FIGS. 6 and 7 show an example of outline points and segments of the sample embroidery design pattern of FIG. 1 generated in the fourth "loop through" of the presently preferred method of the present invention.

At this point in the presently preferred method of the present invention, the outline is preferably complete and the system may conventionally display the Outline of the design on the computer display screen. The user may then readily edit and manipulate the outline at this point. Edits which may readily be made in accordance with the preferred method of the present invention include converting straight line portions of a design pattern to smoothed curves, converting a portion or all of the stitching in a design from one type of stitching, such as satin, bean or tatami, to a different type of stitching, changing stitch lengths in any fill patterns or stitch runs, changing the fill patterns in any fill stitches, adding or deleting automatic underlay stitching, changing the density of stitching in any portion of a design, moving or deleting any portion or point, copying, rotating, scaling, and mirroring any portion of a design, correcting satin segment points which are reversed, changing fill angles, changing the order of sewing segments, and changing the color of any portion of a design. Additionally, the user may preferably correct any inaccurate or undesired conversions or inaccuracies which existed in the original design pattern. The outline format of the present invention preferably permits a user to instantly review and visualize the changes which have been made to the original design pattern. The completed new design pattern may preferably be output and stored on different types of media in either stitch data or condensed data form to be used in conjunction with conventional embroidery machines.

The presently preferred method of the present invention has been described; nevertheless, numerous variations and alternative embodiments of the invention and the parameters and features incorporated therein are available and possible. Moreover, it should be noted that having described the presently preferred method of the present invention, it would be readily apparent to a person of ordinary skill in the art, to conventionally program a computer, such as an IBM PC compatible, to operate in accordance with this method, with the actual program being dependent on the desired conventional computer, selected with the particular computer and associated programming per se not being part of the present invention.

I claim:

1. A method for converting an embroidery design pattern from a stitch data format to an outline data format, said stitch data format comprising a plurality of stitch points and a plurality of control codes, said design pattern comprising at least one group of related stitch points each group having a shape, each group of related stitch points having one of a plurality of stitch types, each of said stitch types comprising said related stitch points each having an associated stitch vector; said method comprising the steps of:

(a) analyzing said stitching data for identifying control codes;

(b) determining an angle formed at each stitch point of said embroidery design pattern from said associated stitch vectors in said stitch pattern, and determining based on a commonality of said angles over a plurality of said stitch points which of said stitch points are related as groups, and determining a stitch type for each of said groups of stitch points;

(c) selecting a plurality of points and angles from a particular group of stitch points, and determining based upon the stitch type of said particular group of stitch points an outline of said particular group of stitch points, said outline having a shape corresponding to the shape of said particular group of stitch points and outline data points which comprise a subset of said particular group of stitch points.

2. A method in accordance with claim 1, wherein the step of determining which of said plurality of stitch points are related as groups comprises the step of defining at least two groups each having a different commonality of said angles over said plurality of stitches in said pattern; said selecting step comprising the step of forming said outline of said pattern from selecting said plurality of outline points from said angles at said stitch points in each of said groups of related stitch points.

3. A method in accordance with claim 1, wherein each of said stitches and said control codes of said embroidery design pattern are assigned absolute cartesian coordinates.

4. A method in accordance with claim 1, further comprising the step of estimating or setting a stitch density for groups of stitches determined to be satin type stitches.

5. A method in accordance with claim 1, further comprising the step of estimating or setting a stitch density for groups of stitches determined to be tatami type stitches.

6. A method in accordance with claim 1, further comprising the step of estimating or setting a stitch fill pattern for groups of stitches.

7. A method in accordance with claim 1, further comprising the step of determining a length of the stitches of said embroidery design pattern.

8. A method according to claim 1 further comprising the step of editing the outline points or stitch type of a particular group of stitch points to modify the shape or stitch type of said particular group of stitch points to form a new embroidery design pattern outlines comprising a plurality of new outline points.

9. A method in accordance with claim 8, wherein said editing step includes the step of changing any of said group of stitch points from linear to curvilinear.

10. A method in accordance with claim 8, wherein said editing step further comprises the step of visually displaying said plurality of outline points for editing.

11. A method in accordance with claim 8, wherein said editing step includes the step of changing the type of stitch in any of said groups of stitch points to a different type of stitch.

12. A method in accordance with claim 8, wherein said editing step includes the step of changing any of said groups of related stitches from curvilinear runs to linear runs.

13. A method in accordance with claim 1, further comprising the step of assigning absolute cartesian coordinates for each said stitch and said control code of said embroidery design pattern.

14. A method in accordance with claim 8, wherein said editing step includes the step of changing any of said groups of related stitches from linear runs to curvilinear runs.

15. A method in accordance with claim 8, wherein said editing step further comprises the step of visually displaying said plurality of outline points for editing.

16. A method in accordance with claim 1, further comprising the step of modifying the shape of said outline.

* * * * *